US009628932B2

(12) United States Patent
Kron

(10) Patent No.: US 9,628,932 B2
(45) Date of Patent: Apr. 18, 2017

(54) METHOD FOR PROCESSING A MULTICHANNEL SOUND IN A MULTICHANNEL SOUND SYSTEM

(71) Applicant: KRONOTON GMBH, Reinbek (DE)

(72) Inventor: Gunnar Kron, Aumühle (DE)

(73) Assignee: Kronoton GmbH, Reinbek (DE)

( * ) Notice: Subject to any disclaimer, the term of this patent is extended or adjusted under 35 U.S.C. 154(b) by 0 days.

(21) Appl. No.: 14/765,408

(22) PCT Filed: Feb. 4, 2013

(86) PCT No.: PCT/EP2013/052127
§ 371 (c)(1),
(2) Date: Aug. 3, 2015

(87) PCT Pub. No.: WO2014/117867
PCT Pub. Date: Aug. 7, 2014

(65) Prior Publication Data
US 2015/0382125 A1 Dec. 31, 2015

(51) Int. Cl.
*H04S 3/02* (2006.01)
*H04S 5/02* (2006.01)

(52) U.S. Cl.
CPC ..... *H04S 3/02* (2013.01); *H04S 5/02* (2013.01); *H04S 2400/13* (2013.01)

(58) Field of Classification Search
USPC ..... 381/1, 17, 18, 307, 27, 19–23
See application file for complete search history.

(56) References Cited

U.S. PATENT DOCUMENTS

| | | | | |
|---|---|---|---|---|
| 5,046,098 | A | 9/1991 | Mandell et al. | |
| 5,771,295 | A | 6/1998 | Waller | |
| 5,970,153 | A | 10/1999 | Petroff | |
| 6,697,491 | B1 | 2/2004 | Griesinger | |
| 7,035,413 | B1 * | 4/2006 | Waller, Jr. | H04S 3/02 381/17 |
| 8,755,530 | B2 | 6/2014 | Kron | |
| 2004/0125960 | A1 | 7/2004 | Fosgate et al. | |
| 2007/0223751 | A1 | 9/2007 | Dickins et al. | |
| 2011/0116639 | A1 * | 5/2011 | Yamada | G10L 19/008 381/17 |
| 2012/0263306 | A1 * | 10/2012 | McGowan | H04R 1/403 381/17 |

FOREIGN PATENT DOCUMENTS

WO 2010015275 A1 2/2010

* cited by examiner

*Primary Examiner* — Maria El-Zoobi
(74) *Attorney, Agent, or Firm* — Dienwiebel Transatlantic IP

(57) ABSTRACT

The invention relates to a method for processing a multichannel sound in a multichannel sound system, wherein the input signals L and R are decoded, preferably as stereo signals. The aim of the invention is to develop the method such that a further improvement of the spatial reproduction of the input signals L and R is achieved on the basis of an extraction of direction components. According to the invention, this is achieved in that the signals R and L are decoded at least into two signals of the form nL-mR, in which n, m=1, 2, 3, 4.

17 Claims, 2 Drawing Sheets

METHOD FOR PROCESSING A MULTICHANNEL SOUND IN A MULTICHANNEL SOUND SYSTEM

The invention relates to a method for processing a multichannel sound in a multichannel sound system, wherein the input signals L and R are decoded, preferably as stereo signals.

BACKGROUND

Methods of the initially named type are known.

In the previously known method disclosed in publication U.S. Pat. No. 5,046,098, the front signals L' and R' as well as the center signal C and the surround signal S are generated in that the center signal $C=a_1*L+a_2*R$ and the surround signal $S=a_3*L-a_4*R$ and the front signals $L'=a_5*L-a_6*C$ and $R'=a_7*R-a_8*C$ are formed from the two input signals L and R through summing and difference formation. The coefficients $a_1 \ldots a_8$ of these weighted summations are derived from level measurements. In order to control this difference formation, two control signals are calculated from the level difference of a left and right channel $D_{LR}$ and from the level difference of a sum and difference signal $D_{CS}$. These two control signals are changed with time-variant response times in this dynamic. Four individual weighting factors $E_C$, $E_C$, $E_L$ and $E_R$, which enable a time-variant output matrix for calculating the front signals L' and R' as well as the center signal C and the surround signal S, are then derived from these two time-variant new control signals.

The publication US 2004/0125960 A1, which contains an enhancement of the decoding with time-variant control signals, discloses a further method of the initially named type. The two front signals $L_{out}$ and $R_{out}$ are thereby obtained from the two input signals L and R and the subtraction of a weighted sum signal (L+R) and a weighted difference signal (L-R). The center signal C results from the sum (L+R) and the subtraction of the weighted input signals L and R. The surround signal S results from the sum (L-R) and the subtraction of the weighted input signals L and R. The weight coefficients $g_l$, $g_r$, $g_c$ and $g_s$ are obtained from a level adjustment of the signals L and R or respectively L+R and L−R in a recursive structure.

In publication U.S. Pat. No. 6,697,491 B1, the level difference calculation for L/R and (L+R)/(L−R) also serves to derive control signals for the weighted matrix decoding in the processing of multichannel sound.

In the multichannel sound method described in publication U.S. Pat. No. 5,771,295, the front signals $L_O$ and $R_O$, the center signal $C_O$ and the surround signals $L_{RO}$ and $R_{RO}$ are derived from stereo signals, i.e., from the input signals L and R. For each of the signals, the respective other signals with a weighting are subtracted from the signals L, R, L+R and L−R. Within the framework of this previously known method for processing a multichannel sound, frequency-dependent weight factors are derived in addition to level ratio calculations. The center signal C thereby only varies in the level, whereas the two surround signals $L_{RO}$ and $R_{RO}$ are derived in two frequency bands and in a phase-inverted manner.

The described methods for processing a multichannel sound in a multichannel sound system were mainly developed for the processing of movie sound signals. It was hereby important to reproduce in a directionally accurate manner dynamically occurring directions of signals, usually in the form of voice and effect signals, spatially over several speakers. The dynamic activation of these multichannel signals supports the directional perception for these types of signals. However, in contrast, the direction information in musical stereo recordings is not dynamic to a high degree, but rather static and only changes slightly for special spatial effects. Acoustic examinations within the framework of the method disclosed in publication US 2004/0125960 A1 show minimal control of the direction information, since dominant directions seldom occur within a stereo mix. This time-variant multichannel control ensures a spatial shift of the signal when a stereo encoding is then performed again.

In contrast, an extraction of direction signal components and their weighting through static or frequency-dependent weighting is considerably more important for a spatial resolution improvement of stereo signals. Thus, the publication WO 2010/015275 A1 represents an important advancement of the method of the initially named type, since the splitting of stereo signals into spatial components takes place here in order to evaluate them with different level regulators. The evaluated spatial signals are then recombined into a stereo signal. Due to the weighting of the spatial signal components, the spatial reproduction of the stereo signal is improved.

SUMMARY

An object of the invention is to further develop a method of the initially named type such that a further improvement in the spatial reproduction of the input signals L and R is achieved based on an extraction of direction signal components.

This object is solved with the method of claim 1. Embodiments of the invention are described, e.g., in the dependent claims.

According to one embodiment of the invention, R and L are decoded at least into two signals of the form nL-mR, in which n, m=1, 2, 3, 4. An improvement in the spatial reproduction and transparency of the input signals L and R is hereby provided. For this, the signals L−R (i.e. with n, m=1) and 2L−R (i.e. with n=2 and m=1) may be formed during the decoding.

The signals L and R are in one embodiment decoded into a spatial signal R and into a center signal. The spatial signal is thereby formed from the difference of the signals L and R ($R_L$) and/or from the difference of the signals R and L ($R_R$).

Contrary to the conventional methods, which provide for a splitting of the signals L and R into the front signals $L_{front}$ and $R_{front}$, the center signal C and the surround signals $S_L$ and $S_R$, a spatial and stereo expansion of a stereo signal is achieved through an expansion of the stereo splitting by a method according to an embodiment of the invention. For this, the spatial signals $R_L$=L−R and $R_R$=R−L are also calculated from the input channels R and L.

These properties have been verified for the following systems:

Behringer MS40 monitor speakers
Toshiba notebook
IMAC27 computer
LG GM 205 mobile telephone with DolbyMobile
Philips 42PFL9703D flatscreen television with BBE Surround
JBL On Stage 400p docking station Comparisons to DolbyMobile, Virtual Dolby Surround and other stereo spatializers show that the method according to an embodiment of the invention generates a mainly neutral improvement of the stereo sound pattern.

Within the framework of psychoacoustic examinations, the derivation of the surround signals from the difference L−R also proved to be another possible step for an improved stereo and spatial expansion. After an intensive audiometry test, the ratio of the surround signals $S_L$=2L−R and $S_R$=2R−L hereby proved to be beneficial. An embodiment of the invention thus provides that the surround signal $S_L$=2L−R and the surround signal $S_R$ are formed from the difference $S_R$=2R−L.

A frequency-dependent weighting of the surround signals may in one embodiment be provided. A frequency-dependent weighting of the signals $S_L$ and $S_R$ thus may take place. The frequency-dependent weighting may take place by means of a height-shelving filter.

The signals L and R may in another embodiment be added to the signals $L_P$ and $R_P$.

An audio system for performing a method according to one or more embodiments described herein is the object of claim 13, wherein the audio system comprises a signal processor, preferably in the form of an audio processor.

A software, which is located on a signal processor, i.e., is imported onto the signal processor, is also provided within the framework of another embodiment the invention. The software thereby contains an algorithm, which is executed by the signal processor, wherein the algorithm includes a method according to one or more embodiments described herein.

Moreover, the invention according to one embodiment provides a signal processor for performing a method according to one or more embodiments described herein.

The invention is described in greater detail below based on a drawing.

BRIEF DESCRIPTION OF THE DRAWINGS

It is shown in

DETAILED DESCRIPTION OF PREFERRED EMBODIMENTS

Figure 1:
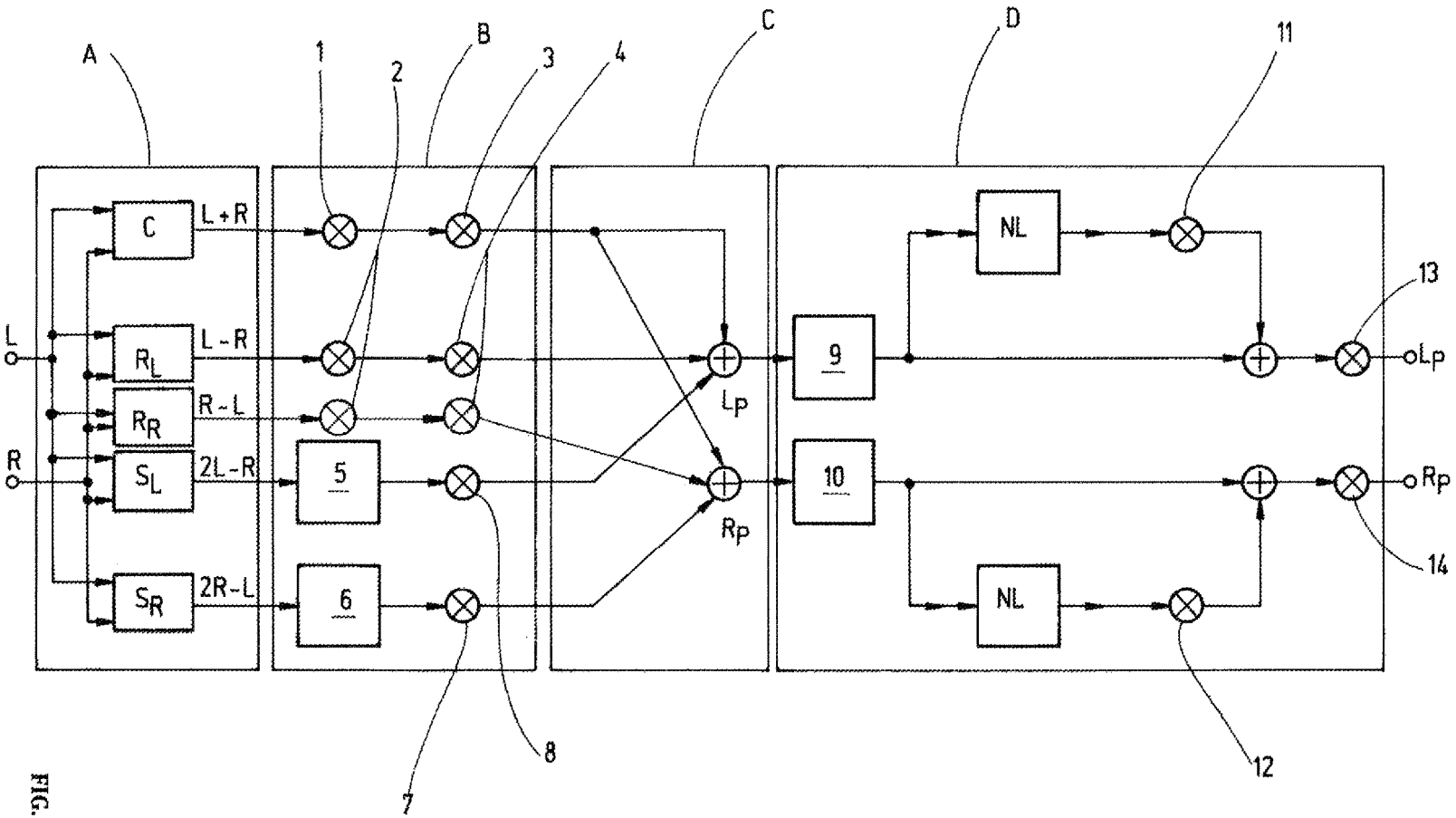
FIG. 1 a method according to an embodiment of the invention in a schematic representation, comprising four method sections A, B, C, D.
Figure 2:
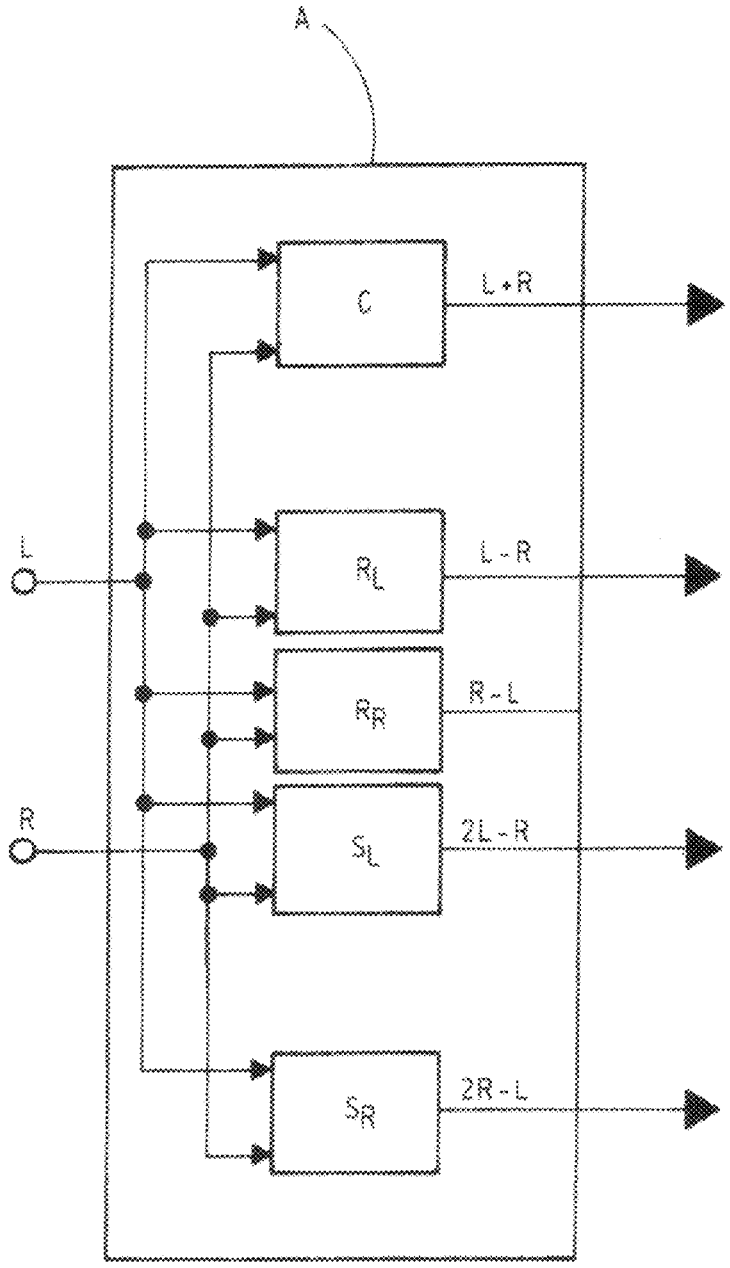
FIG. 2 shows an enlarged view of the method section A from FIG. 1.

FIG. 1 shows an embodiment of the method according to the invention, which comprises four method sections A, B, C, D. Individually, the method sections concern the following:

the decoding (method section A), the processing of the decoded signals (method section B), the encoding (method section C), the processing of the encoded signals (method section D).

The method according to this embodiment begins in that, within the framework of the decoding, the input signals L and R, which are present as stereo signals, are split into three signal components, wherein the signals L and R can remain intact. The signal components are the center signal C, the spatial signal R as well as the surround signals $S_L$ and $S_R$. The center signal C is thereby a single-channel, i.e., it contains only the channel C, while the spatial signal R and the surround signal S are dual-channel, i.e., they contain the signals $R_L$ and $R_R$ or respectively $S_L$ and $S_R$. The surround and spatial signals $S_L$, $S_R$ as well as $R_L$ and $R_R$ thereby contain the direction and spatial information of the stereo signals L and R.

In method section A, the signals, i.e., the single-channel center signal C=L+R, also called a mono signal, the stereo component $R_L$=L−R and $R_R$=R−L of the dual-channel spatial signal R as well as the two dual-channel surround channels $S_L$=2L−R and $S_R$=2R−L, are decoded from the stereo signals R and L into five parallel stages.

The method section A is followed by the method section B, in which the processing of the channels C, $R_L$, $R_R$, $S_L$ and $S_R$ takes place. In order to adjust the volume of the center signal C and of the spatial signal $R_L$=L−R and $R_R$=R−L, these signals are provided by first level regulators 1, 2 with a level weighting, which manifests itself in the factor 1.5. After this first level weighting, a further variable level weighting, which weights the sound characteristics of the decoded signals to L, R, is performed by the further level regulators 3, 4.

In contrast, the two surround signals $S_L$=2L−R and $S_R$=2R−L are delivered to height-shelving filters 5, 6, through which the frequency response of the surround signals $S_L$ and $S_R$ are set. A frequency-dependent weighting of the signals $S_L$ and $S_R$ thus takes place, wherein the filters 5, 6 comprise a minimal phase shift in the frequency range around preferably 2 kHz so that cancellation effects during the encoding taking place in method section C are minimized, but the actual amplifying effect is simultaneously emphasized and namely with a height-shelving frequency response around, e.g., 3 dB at preferably 2 kHz. The surround signals $S_L$, $S_R$ are then delivered to the level regulators 7, 8, which weight the sound characteristics of the decoded signals to $S_L$, $S_R$.

During the encoding, i.e., in the method section C, the following thus results after summation, which is already given in method step A, of the signals C, $R_L$, $R_R$, $S_L$, $S_R$ in the form:

$$L_P=C+R_L+S_L=(L+R)+(L-R)+(2L-R)=4L-R$$

$$R_P=C+R_R+S_R=(L+R)+(R-L)+(2R-L)=4R-L$$

the encoded stereo signals $L_P$, $R_P$ according to $$L_P=V_C C+V_R R_L+V_S S_L=V_C(L+R)+V_R(L-R)+V_S(2L-R)$$

$$R_P=V_C C+V_R R_R+V_S S_R=V_C(L+R)+V_R(R-L)+V_S(2R-L)$$

or respectively after filtering of the surround signals $S_L$, $S_R$ $$L_P=V_C C+V_R R_L+V_S(S_L)_{Filtered}=V_C(L+R)+V_R(L-R)+V_S(2L-R)_{Filtered}$$

$$R_P=V_C C+V_R R_R+V_S(S_R)_{Filtered}=V_C(L+R)+V_R(R-L)+V_S(2R-L)_{Filtered}$$

In the last method section D, the encoded weighted signals $L_P$, $R_P$ are post-processed by stereo equalizers 9, 10. A special non-linear characteristic line NL is used for further enhancement of the sound pattern. This non-linear characteristic line forms an input amplitude x over an output amplitude y. The used, non-linear characteristic line y=f(x) is $$y=\tan h((1/7.522*a\ \tan(7.522*x).*(\mathrm{sign}(x)+1)./2.+x*(\mathrm{sign}(-x)+1)./2)/0.5)*0.5$$

Harmonic overtones are added to the direct music signal via this characteristic line. Finally, the signals $L_P$, $R_P$ are post-processed further in the method section D such that the level regulators 11, 12 determine the degree of overtone admixing to the direct signal. Further processing finally takes place by the level regulators 13, 14, which make the overall level of the method result adjustable.

The present invention in this design is not restricted to the exemplary embodiment specified above. Rather, a plurality of variants are conceivable, which also use the represented solution in different designs. For example, within the framework of method section D, maximizers, i.e., compressors/limiters, can be used to further enhance the sound pattern.

LIST OF REFERENCE NUMERALS

1, 2 First level regulators
3, 4 Further level regulators
5, 6 Height-shelving filters
7, 8 Level regulators
9, 10 Stereo equalizers
11, 12, 13, 14 Further components

What is claimed is:

1. A method for processing a multichannel sound in a multichannel sound system, in which the input signals L and R are decoded as stereo signals, and in which
decoding includes generating at least two signals of the form nL−mR with n, m=1, 2, 3, 4 from the signals R and L.

2. The method according to claim 1, wherein
decoding includes generating a spatial signal R and a center signal from the signals L and R, wherein a spatial signal $R_L$ is formed from the difference of the signals L and R and/or a spatial signal $R_R$ from the difference of the signals R and L.

3. The method according to claim 1, wherein
a surround signal $S_L$ is formed from the difference $S_L$=2L−R and a surround signal $S_R$ from the difference $S_R$=2R−L.

4. The method accord to claim 2, wherein
an encoding provides signals $L_P$, $R_P$ in the form $$L_P=C+R_L+S_L=(L+R)+(L-R)+(2L-R)=4L-R \text{ and}$$

$$R_P=C+R_R+S_R=(L+R)+(R-L)+(2R-L)=4R-L.$$

5. The method according to claim 3, wherein
the signals $R_L$, $R_R$, C, $S_L$ and $S_R$ Contain a level weighting $V_C$, $V_R$, $V_S$, wherein an encoding provides signals $L_P$, $R_P$ in the form $$L_P=V_C C+V_R R_L+V_S S_L=V_C(L+R)+V_R(L-R)+V_S(2L-R) \text{ and}$$

$$R_P=V_C C+V_R R_R+V_S S_R=V_C(L+R)+V_R(R-L)+V_S(2R-L).$$

6. The method according to claim 3, wherein
a frequency-dependent weighting of the signals $S_L$ and $S_R$ takes place.

7. The method according to claim 6, wherein
the frequency-dependent weighting takes place by means of a height-shelving filter.

8. The method according to claim 4, wherein
the signals $L_P$, $R_P$ are filtered by means of an equalizer.

9. The method according to claim 4, wherein
harmonic overtones are added to the signals $L_P$, $R_P$.

10. The method according to claim 9, wherein
the addition of the harmonic overtones takes places by means of a maximizer or a non-linear characteristic line $N_L$.

11. The method according to claim 4, wherein
the signals L and R am added to the signals $L_P$ and $R_P$.

12. An audio system for performing the method according to claim 1, wherein the system comprises a signal processor.

13. A non-transitory software, which is imported onto a signal processor, wherein
the software contains an algorithm, which is executed by the signal processor, wherein the algorithm includes the method according to claim 1.

14. A signal processor for performing the method according to claim 1.

15. The method according to claim 2, wherein
a surround signal $S_L$ is formed from the difference $S_L$=2L−R and a surround signal $S_R$ from the difference $S_R$=2R−L.

16. The method according to claim 3, wherein
an encoding provides signals $L_P$, $R_P$ in the form $$L_P=C+R_L+S_L=(L+R)+(L-R)+(2L-R)=4L-R \text{ and}$$

$$R_P=C+R_R+S_R=(L+R)+(R-L)+(2R-L)=4R-L.$$

17. The method according to claim 4, wherein
the signals $R_L$, $R_R$, C, $S_L$ and $S_R$ contain a level weighting $V_C$, $V_R$, $V_S$, wherein
an encoding provides signals $L_P$, $R_P$ in the form $$L_P=V_C C+V_R R_L+V_S S_L=V_C(L+R)+V_R(L-R)+V_S(2L-R) \text{ and}$$

$$R_P=V_C C+V_R R_R+V_S S_R=V_C(L+R)+V_R(R-L)+V_S(2R-L).$$

* * * * *